US011419479B2

(12) United States Patent
Kim et al.

(10) Patent No.: US 11,419,479 B2
(45) Date of Patent: Aug. 23, 2022

(54) SUPPORTING DEVICE AND DISH WASHER HAVING THE SAME

(71) Applicant: SAMSUNG ELECTRONICS CO., LTD., Suwon-si (KR)

(72) Inventors: Jaejun Kim, Suwon-si (KR); Daejoung Kim, Suwon-si (KR); Gisung Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 283 days.

(21) Appl. No.: 16/803,133

(22) Filed: Feb. 27, 2020

(65) Prior Publication Data

US 2020/0281441 A1 Sep. 10, 2020

(30) Foreign Application Priority Data

Mar. 6, 2019 (KR) ..... 10-2019-0025656

(51) Int. Cl.
*A47L 15/50* (2006.01)

(52) U.S. Cl.
CPC ..... *A47L 15/505* (2013.01); *A47L 15/503* (2013.01); *A47L 15/501* (2013.01)

(58) Field of Classification Search
None
See application file for complete search history.

(56) References Cited

U.S. PATENT DOCUMENTS 7,051,384 B1 5/2006 Guillot et al.
9,179,819 B2 11/2015 Ryu et al.
2014/0132136 A1* 5/2014 Kilic ..... A47L 15/503 312/228.1

(Continued)

FOREIGN PATENT DOCUMENTS

CN 202604765 U * 12/2012 ..... A47L 15/50
CN 106539549 A * 3/2017 ..... A47L 15/50
CN 108294718 A * 7/2018 ..... A47L 15/501

(Continued)

OTHER PUBLICATIONS

International Search Report dated Jun. 26, 2020 in International Patent Application No. PCT/KR2020/002685.

(Continued)

*Primary Examiner* — Joseph L. Perrin
*Assistant Examiner* — Irina Graf
(74) *Attorney, Agent, or Firm* — Staas & Halsey LLP

(57) ABSTRACT

A dish washer includes: a basket; a first supporting member coupled to the basket in such a way to be rotatable between a first position of being folded to the basket and a second position of being unfolded from the basket; a second supporting member positioned below the first supporting member and coupled to the basket in such a way to be rotatable between a third position of being folded to the basket and a fourth position of being unfolded from the basket; and a connecting member rotating the second supporting member from the third position to the fourth position when the first supporting member rotates from the first position to the second position, wherein one end of the connecting member is connected to the first supporting member and the other end of the connecting member is connected to the second supporting member.

20 Claims, 16 Drawing Sheets

(56) References Cited

U.S. PATENT DOCUMENTS

2018/0146837 A1 5/2018 Mesa et al.

FOREIGN PATENT DOCUMENTS

| | | | | | |
|---|---|---|---|---|---|
| DE | 19540611 | A1 * | 5/1997 | ..... | A47L 15/50 |
| DE | 10 2006 055 346 | A1 | 5/2008 | | |
| DE | 10 2010 031 074 | A1 | 1/2012 | | |
| DE | 102011085417 | A1 * | 5/2013 | ..... | A47L 15/503 |
| DE | 10 2013 110 531 | A1 | 4/2015 | | |
| EP | 1275336 | A1 * | 1/2003 | ..... | A47L 15/502 |
| EP | 1 859 722 | A1 | 11/2007 | | |
| EP | 2008570 | A1 * | 12/2008 | ..... | A47L 15/503 |
| EP | 2074925 | A1 * | 7/2009 | ..... | A47L 15/502 |
| EP | 2103245 | A1 * | 9/2009 | ..... | A47L 15/503 |
| EP | 1 929 928 | B1 | 2/2012 | | |
| EP | 2 815 690 | A1 | 12/2014 | | |
| EP | 3037028 | A1 * | 6/2016 | ..... | A47L 15/503 |
| WO | WO-9846113 | A1 * | 10/1998 | ..... | A47L 15/503 |
| WO | WO-2012089464 | A1 * | 7/2012 | ..... | A47L 15/503 |
| WO | WO 2016/034201 | A1 | 3/2016 | | |

OTHER PUBLICATIONS

European Search Report dated May 7, 2020 in European Patent Application No. 20161187.8-1016.

* cited by examiner

SUPPORTING DEVICE AND DISH WASHER HAVING THE SAME

CROSS-REFERENCE TO RELATED APPLICATION

This application is based on and claims priority under 35 U.S.C. § 119 to Korean Patent Application No. 10-2019-0025656, filed on Mar. 6, 2019 in the Korean Intellectual Property Office, the disclosure of which is incorporated by reference herein in its entirety.

BACKGROUND

1. Field

The disclosure relates to a dish washer, and more particularly, to a dish washer having a supporting device for holding a wine glass.

2. Description of the Related Art

A dish washer is a machine for automatically washing off food residues, etc. on dishes with a detergent and water.

A dish washer includes a main body having a front opening, wherein a tub is positioned inside the main body, a door installed on the main body to open and close the front opening, a basket for accommodating dishes, and a spray nozzle for spraying water.

The basket has a shape capable of supporting dishes having various sizes and/or shapes. In the basket, various kinds of dishes are held. Generally, the basket is manufactured as an injection-molded type or a metal wire type.

In the basket, a wine glass may be held. The wine glass has a relatively long length compared to the width, wherein a portion in longitudinal direction of the wine glass is a slender stem and the other portion in longitudinal direction of the wine glass is in the shape of a normal cup. The basket needs to include a separate supporting device for fixing the wine glass due to the shape characteristics of the wine glass. A supporting device for holding a wine glass may be integrated into the basket or detachably installed in the basket.

SUMMARY

Therefore, it is an aspect of the disclosure to provide a dish washer with improved space utilization of a basket.

It is another aspect of the disclosure to provide a dish washer capable of stably fixing and supporting a wine glass.

Additional aspects of the disclosure will be set forth in part in the description which follows and, in part, will be obvious from the description, or may be learned by practice of the disclosure.

In accordance with an aspect of the disclosure, a dish washer includes: a main body; a basket provided inside the main body; a first supporting member coupled to the basket so as to be rotatable between a first position of being folded to the basket and a second position of being unfolded from the basket; a second supporting member positioned below the first supporting member and coupled to the basket so as to be rotatable between a third position of being folded to the basket and a fourth position of being unfolded from the basket; and a connecting member connected to the first supporting member and the second supporting member so as to rotate the second supporting member from the third position to the fourth position when the first supporting member rotates from the first position to the second position.

When the first supporting member rotates from the second position to the first position, the connecting member may rotate the second supporting member from the fourth position to the third position.

When the first supporting member is located at the second position and the second supporting member is located at the fourth position, an angle by which the first supporting member is unfolded may be different from an angle by which the second supporting member is unfolded.

The first supporting member may include a rotation restricting portion supported by the basket and restricting a rotation range of the first supporting member when the first supporting member is at the second position.

The first supporting member may include a fixing portion that fixes to the basket when the first supporting member rotates to the first position.

The first supporting member may include a first holding portion to hold an item to be washed in the dish washer, the first holding portion comprising: a fixing groove into which a part of the item is insertable to be fixed in the fixing groove and thereby held by the first holding portion, and a deformable portion positioned in an opening of the fixing groove and which deforms when the part of the item is inserted into the fixing groove.

The second supporting member may include a holding portion in the shape of a hook bent by a predetermined angle to support an item to be washed in the dishwasher.

When the first supporting member is at the second position, the connecting member may enable the second supporting member to rotate from the fourth position to the third position.

The connecting member may include: a first arm rotatably connected to the first supporting member, a second arm rotatably connected to the second supporting member, and a joint rotatably connecting the second arm to the first arm.

The connecting member may support the first supporting member and the second supporting member so that the first supporting member interworks with the second supporting member.

The first supporting member may further include a fixing member that fixes the connecting member when the second supporting member rotates to the third position.

The first supporting member may include: a first frame rotatably coupled to the basket, and a supporting unit rotatably coupled to the first frame.

When the first supporting member is at the second position, the supporting unit may be rotatable to be in a position to support an item to be rested on the first frame.

The supporting unit may include a first supporting portion and a second supporting portion spaced from the first supporting portion to form a supporting space.

The first supporting member may include a first frame rotatably coupled to the basket, and a plurality of supporting units rotatably coupled to the first frame and which are rotatable independently.

The first supporting member may be configured to, when in the second position, support a stem of a glass to be washed in the dish washer, and the second supporting member may be configured to, when in the fourth position, support a lip of a cup of the glass while the stem is supported by the first supporting member.

In accordance with another aspect of the disclosure, a supporting device includes: a first supporting member rotatably coupled to a first wire of a basket of a dish washer; a second supporting member rotatably coupled to a second wire positioned below the first wire of the basket; and a connecting member connected to the first supporting member and the second supporting member so that the first supporting member and the second supporting member are rotatable together, and, when the first supporting member is not rotating, the second supporting member is rotatable, wherein the first supporting member and the second supporting member are thereby rotatable to be in positions at which the first supporting member and the second supporting member are configured to support item to be washed in the dish washer.

The first supporting member and the second supporting member may be rotatable to set a first mode in which the first supporting member and the second supporting member are unfolded from the basket, a second mode in which the first supporting member and the second supporting member are folded to the basket, and a third mode in which the first supporting member is unfolded from the basket and the second supporting member is folded to the basket.

The first supporting member may further include a supporting unit being protrudable from one surface of the first supporting member to support an item to be washed in the dish washer and resting on the one surface.

The connecting member may include a first arm connected to the first supporting member and a second arm connected to the second supporting member, the second arm being rotatably connected to the first arm.

In accordance with another aspect of the disclosure, a dish washer includes: a main body; a basket provided inside the main body; a first supporting member rotatably coupled to the basket; a second supporting member positioned below the first supporting member, and being rotatably coupled to the basket; and a connecting member connected to the first supporting member and the second supporting member and configured so that the first connecting member and the second connecting member are rotatable to positions at which both the first connecting member and the second connecting member are folded to the basket, the first connecting member and the second connecting member are rotatable to positions at which both the first connecting member and the second connecting member are unfolded from the basket, and the first connection member and the second connection member are rotatable to positions at which the second supporting member is folded to the basket while the first supporting member is unfolded from the basket.

Each of the first connection member and the second connection member may be configured to, when unfolded, support items to be washed in the dish washer.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, embodiments of the present disclosure will be described in detail with reference to the accompanying drawings. Meanwhile, in the following description, the terms "upper", "lower", etc. are defined based on the drawings, and the shapes and positions of the components are not limited by the terms.

Throughout the disclosure, the expression "at least one of a, b or c" indicates only a, only b, only c, both a and b, both a and c, both b and c, all of a, b, and c, or variations thereof.

Hereinafter, dishes are used as a concept embracing bowls, cups, cutlery, various kinds of kitchen tools, etc.

Figure 1:
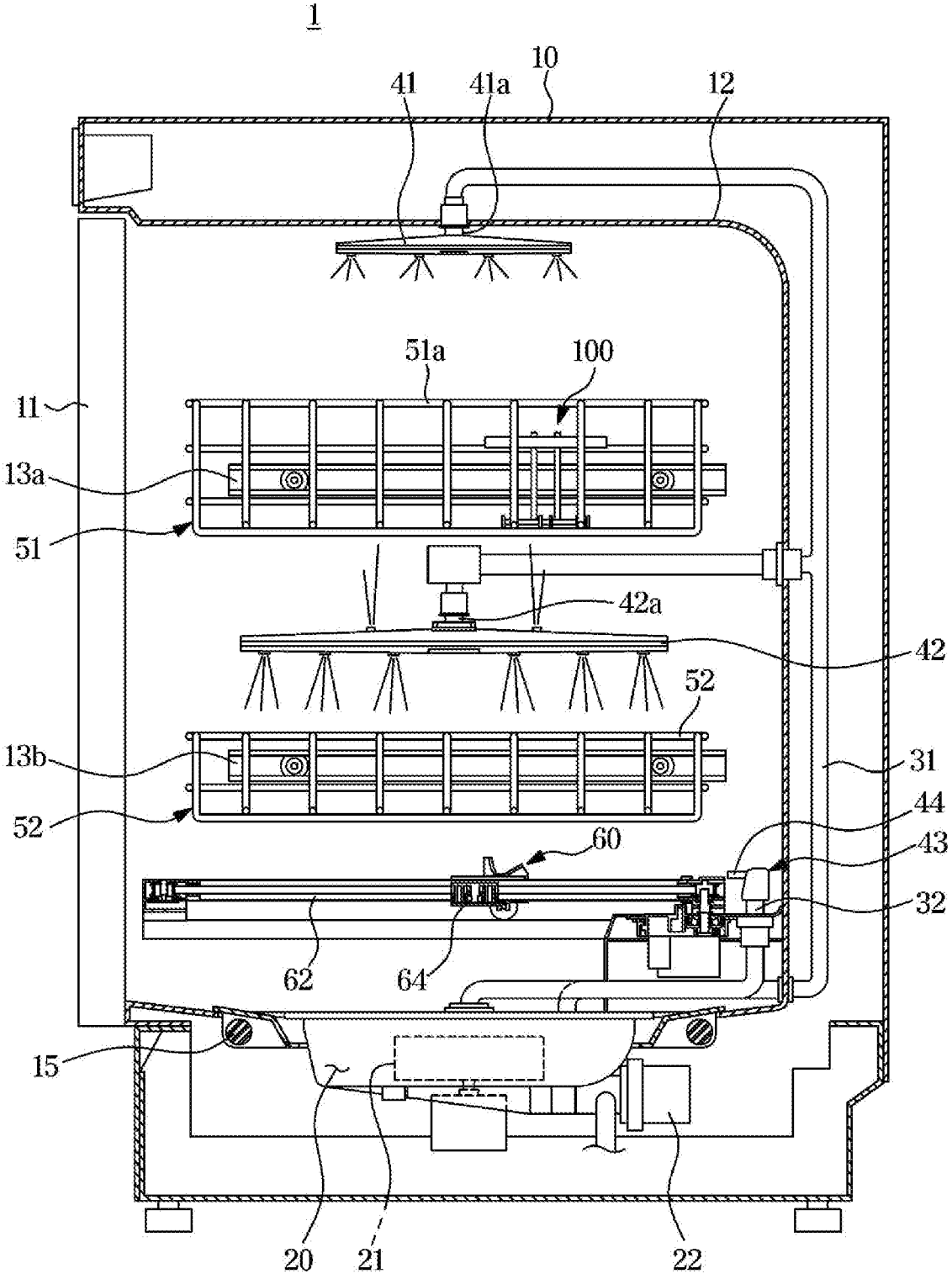
FIG. 1 is a cross-sectional view of a dish washer according to an embodiment of the disclosure.
Figure 2:
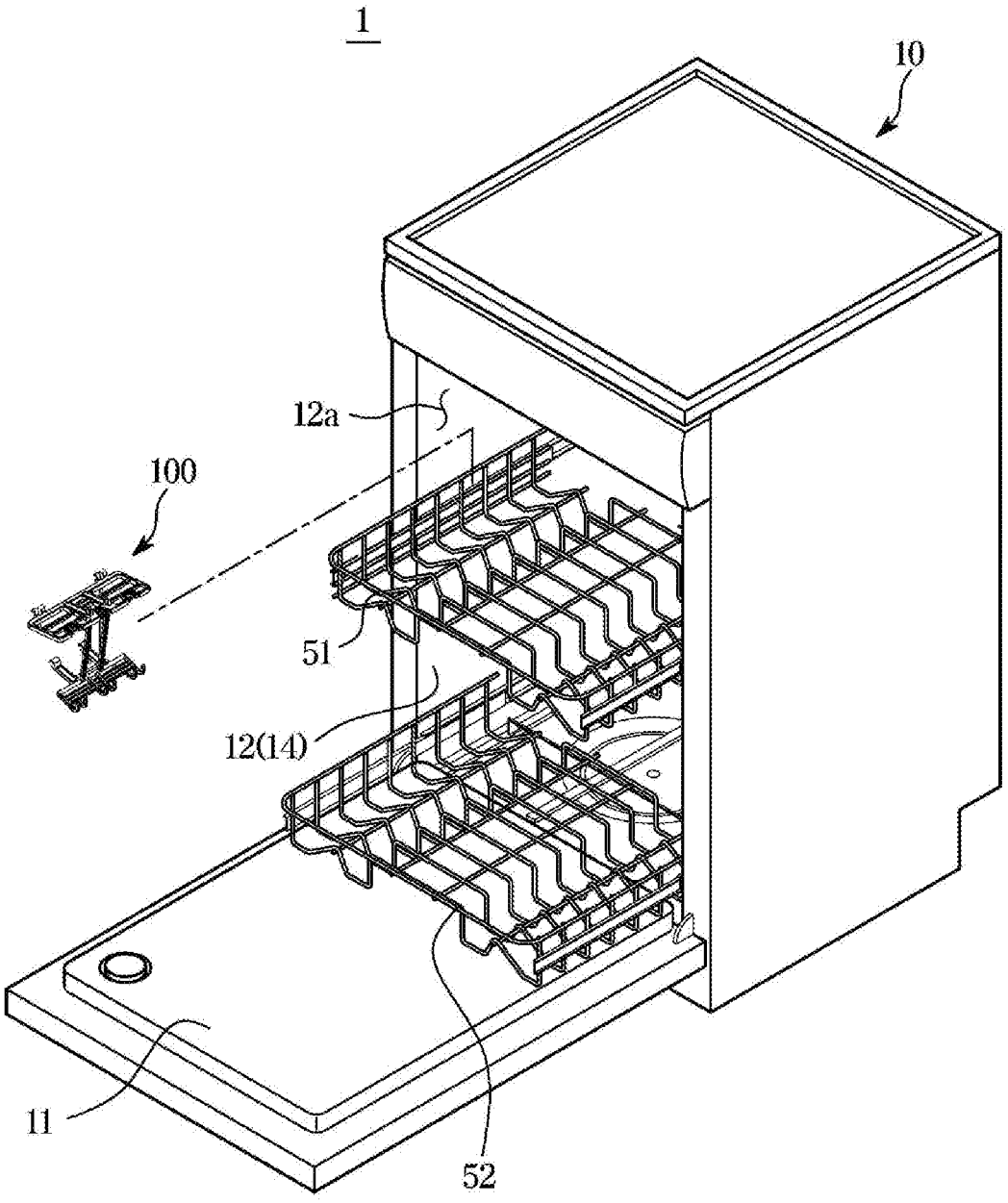
FIG. 2 shows a state in which a front door of the dish washer shown in FIG. 1 opens.

FIG. 1 is a cross-sectional view of a dish washer according to an embodiment of the disclosure. FIG. 2 shows a state in which a front door of the dish washer shown in FIG. 1 opens.

As shown in FIGS. 1 and 2, a dish washer 1 may include a main body 10 forming an external appearance.

The dish washer 1 may further include a tub 12 positioned inside the main body 10. The tub 12 may be substantially in the shape of a box. One side of the tub 12 may open. That is, the tub 12 may have an opening 12*a*. For example, a front side of the tub 12 may open.

The dish washer 1 may further include a door 11 for opening and closing the opening 12*a* of the tub 12. The door 11 may be installed on the main body 10 to open and close the opening 12*a* of the tub 12. The door 11 may be rotatably installed on the main body 10.

The dish washer 1 may include a plurality of baskets 51 and 52 (also referred to as a first basket 51 and a second basket 52) positioned inside the tub 12 to accommodate dishes. In the baskets 51 and 52, dishes having various sizes and/or shapes may be accommodated. In the baskets 51 and 52, various kinds of dishes may be accommodated.

The baskets 51 and 52 may include the first basket 51 positioned in an upper space of the tub 12, and the second basket 52 positioned in a lower space of the tub 12. The first basket 51 may include a first wire 51*a*, and the second basket 52 may include a second wire 52*a*. The first basket 51 may be supported by a first guide rack 13*a*, and the second basket 52 may be supported by a second guide rack 13*b*.

The first guide rack 13*a* and the second guide rack 13*b* may be installed on an inner wall 14 of the tub 12 to be slidable toward the opening 12*a* of the tub 12. The inner wall 14 of the tub 12 may be a concept including surfaces of right and left walls of the tub 12.

The dish washer 1 may further include a sump 20 to collect and store water. In the sump 20, a washing pump 21 may be provided to pump the stored water to a plurality of spray units 41, 42, and 43 (also referred to as a first spray unit 41, a second spray unit 42, and a third spray unit 43). The water pumped by the washing pump 21 may be supplied to the first spray unit 41 and the second spray unit 42 which will be described later through a first supply pipe 31, or to the third spray unit 43 which will be described later through a second spray pipe 32.

The dish washer 1 may further include a heater 15 positioned below the tub 12 to heat water, and a drain pump 22 positioned below the tub 12 to drain water.

The dish washer 1 may further include the spray units 41, 42, and 43 to spray water. The spray units 41, 42, and 43 may include the first spray unit 41 positioned above the first basket 51, the second spray unit 42 positioned between the first basket 51 and the second basket 52, and the third spray unit 43 positioned below the second basket 52.

The first spray unit 41 may be rotatable on a first rotating shaft 41*a*, and the second spray unit 42 may be rotatable on a second rotating shaft 42*a*.

The first spray unit 41 may spray water toward the dishes accommodated in the first basket 51, and the second spray unit 42 may spray water toward the dishes accommodated in the first basket 51 and the second basket 52.

The third spray unit 43 may be fixed to one side of the tub 12, unlike the first spray unit 41 and the second spray unit 42. The third spray unit 43 may spray water in a substantially horizontal direction, and accordingly, water sprayed from the third spray unit 43 may be not headed directly toward the dishes.

The third spray unit 43 may include a plurality of nozzles 44 from which water is sprayed. The nozzles 44 may be arranged in a row at regular intervals from one side of the tub 12 to the opposite side of the tub 12.

Water sprayed in the substantially horizontal direction from the nozzles 44 of the third spray unit 43 may change its direction by a switching assembly 60 positioned inside the tub 12 to be directed toward the dishes accommodated in the second basket 52. The switching assembly 60 may be supported on a guide rail 62 by a holder 64 in such a way to be movable along the guide rail 62.

In at least one of the baskets 51 and 52, a supporting device 100 for fixing and supporting a wine glass may be provided. In FIGS. 1 and 2, the supporting device 100 is provided in the first basket 51, however, the supporting device 100 may be provided in the second basket 52 or in both the first basket 51 and the second basket 52. Hereinafter, for convenience of description, a case in which the supporting device 100 is provided in the first basket 51 will be described. Also, the first basket 51 is referred to as a basket 51, and the first wire 51*a* is also referred to as a wire 51*a*.

Figure 3:
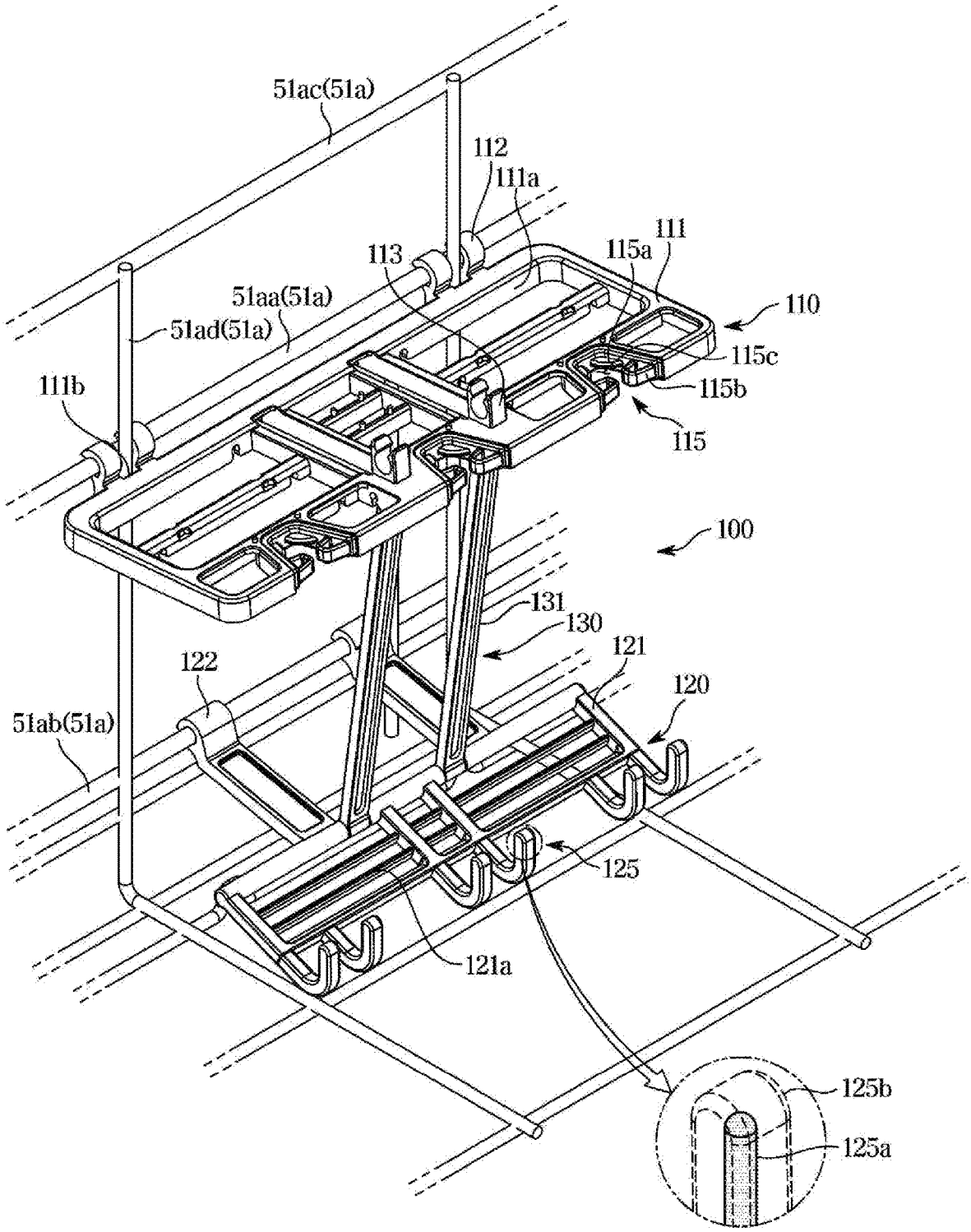
FIG. 3 shows a supporting device shown in FIG. 2.
Figure 4:
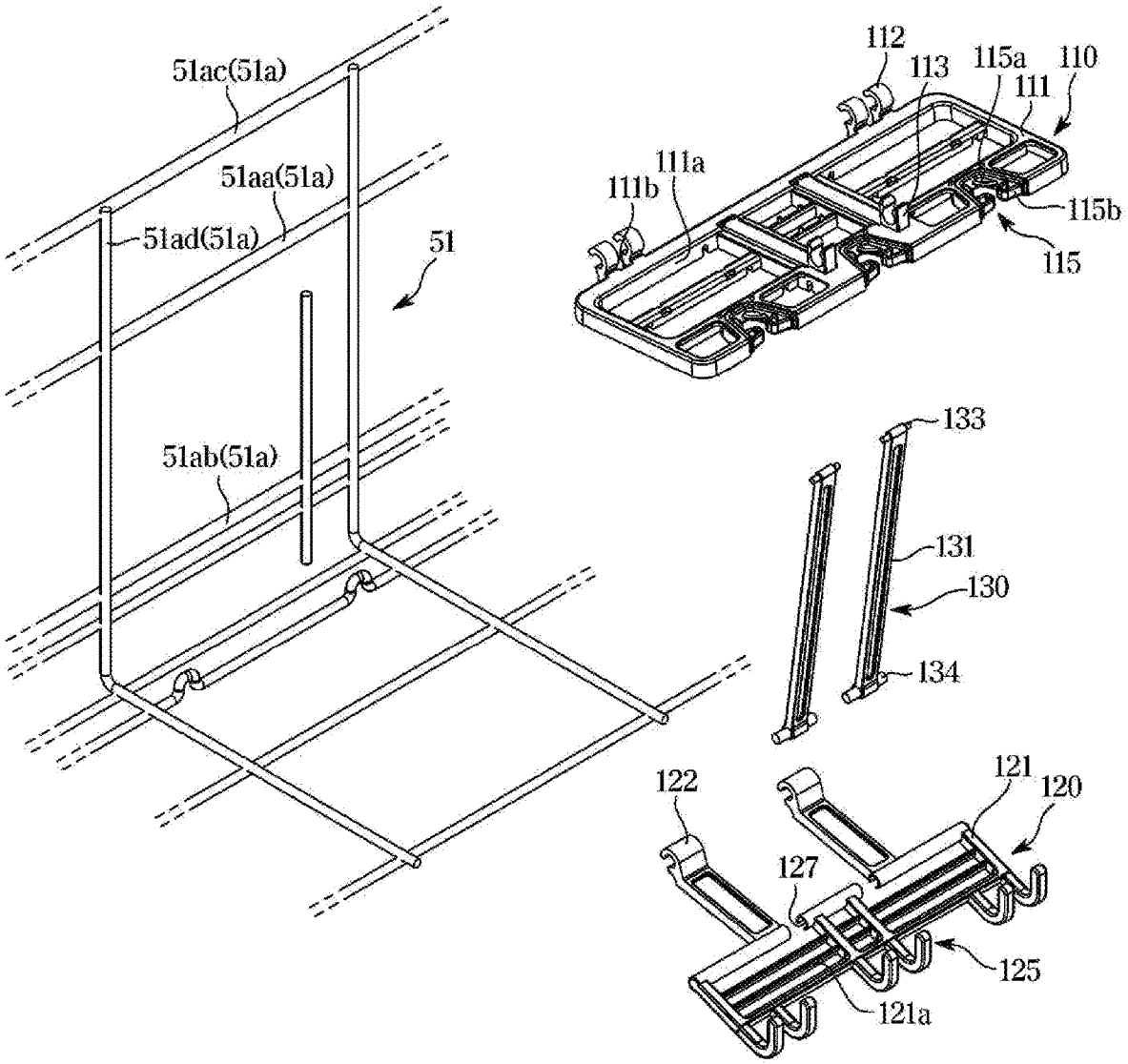
FIG. 4 is an exploded perspective view of the supporting device shown in FIG. 3.
Figure 5:
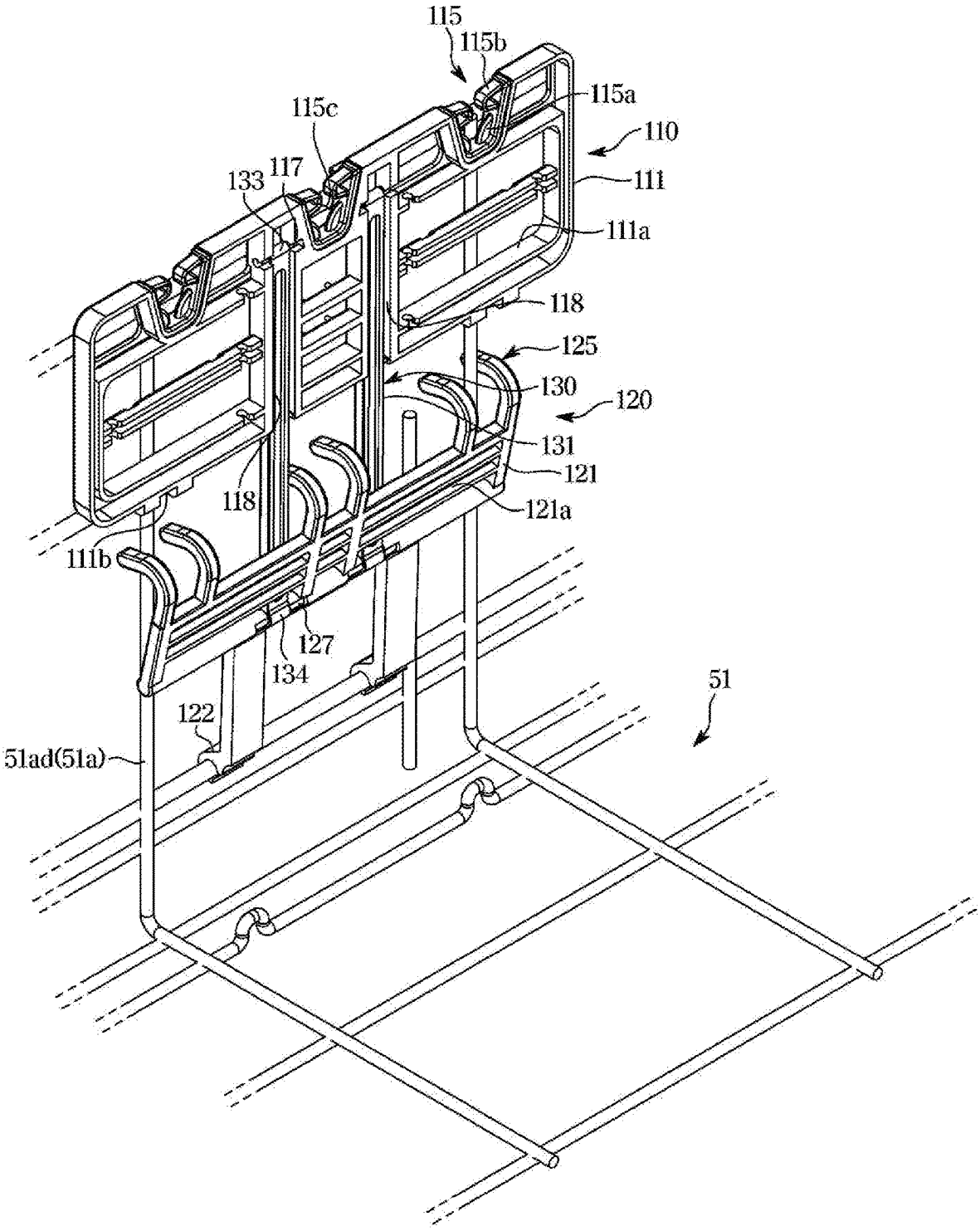
FIG. 5 shows a state in which the supporting device shown in FIG. 3 is set to a second mode.
Figure 6:
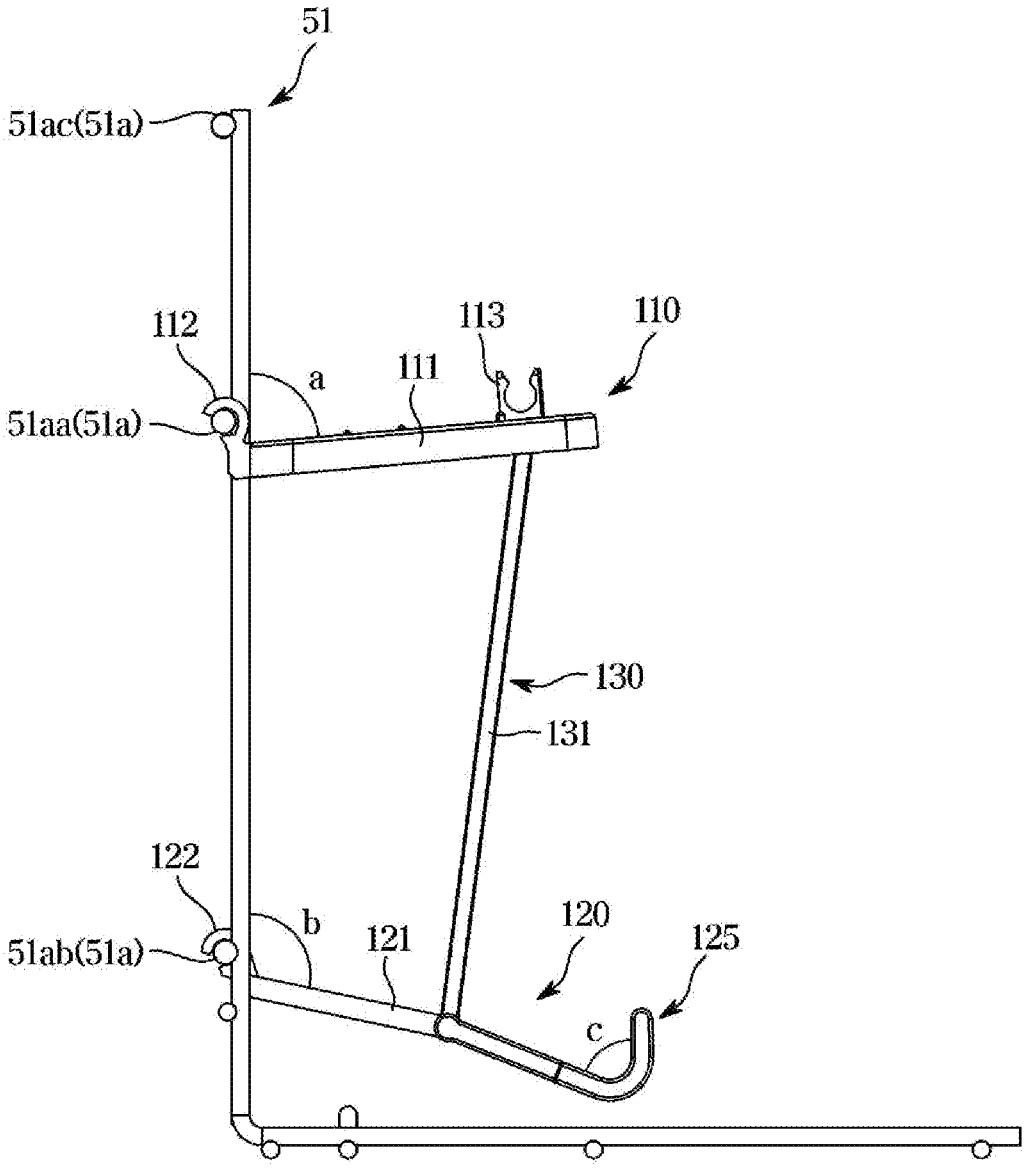
FIG. 6 shows a side of the supporting device shown in FIG. 5.
Figure 7:
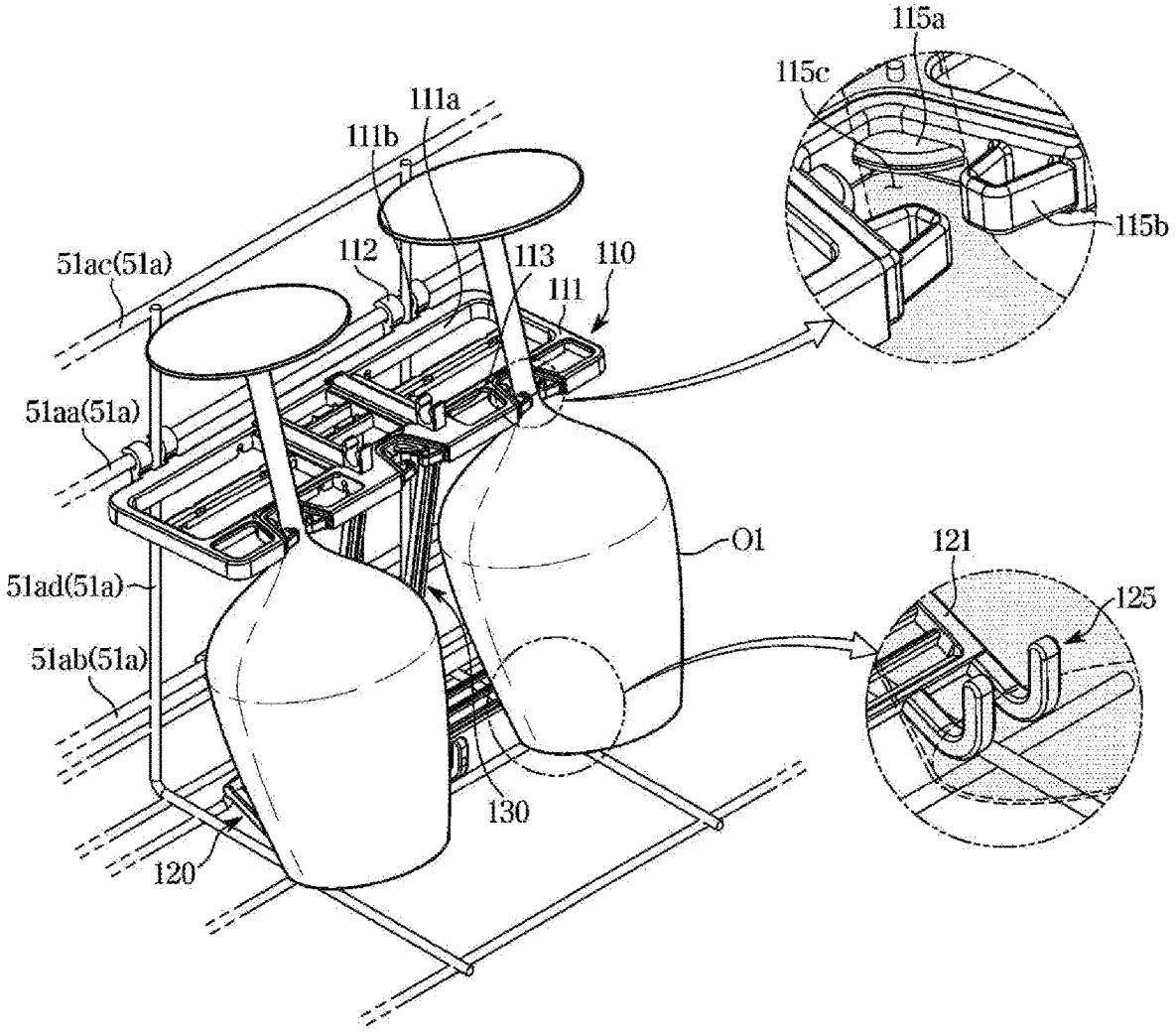
FIG. 7 shows a state in which a wine glass is held in the supporting device shown in FIG. 3.

FIG. 3 shows the supporting device shown in FIG. 2. FIG. 4 is an exploded perspective view of the supporting device shown in FIG. 3. FIG. 5 shows a state in which the supporting device shown in FIG. 3 is set to a second mode. FIG. 6 shows a side of the supporting device shown in FIG. 5. FIG. 7 shows a state in which a wine glass is held in the supporting device shown in FIG. 3.

Referring to FIGS. 3 and 4, the supporting device 100 may be installed in the basket 51. More specifically, the supporting device 100 may include a first supporting member 110 rotatably coupled to one portion of the basket 51, a second supporting member 120 positioned below the first supporting member 110 and rotatably coupled to another portion of the basket 510, and a connecting member 130 enabling the first supporting member 110 to interwork with the second supporting member 120.

The first supporting member 110 may be rotatably coupled to a first supporting wire 51*aa* of the basket 51. The first supporting member 110 may include a first frame 111 for supporting dishes. The first supporting member 110 may be rotatable between a first position of being folded to the basket 51 and a second position of being unfolded from the basket 51.

The first frame 111 may be in the shape of a substantially quadrangular plate, and include a first through hole 111*a* through which water passes when the dish washer 1 washes dishes. When the first supporting member 110 is unfolded with respect to the basket 51, dishes may be rested on an upper surface of the first frame 111.

The first supporting member 110 may include a first wire coupling portion 112 extending from the first frame 111 and coupled to the first supporting wire 51*aa*. The first wire coupling portion 112 may be in the shape of a hook, and rotatably coupled to the first support wire 51*aa*.

The first supporting member 110 may include a wire fixing portion 113 that is fixed to the basket 51 when the first supporting member 110 is folded to the basket 51. The wire fixing portion 113 may protrude from the first frame 111. The wire fixing portion 113 may be in the shape of tongs to fix the first supporting member 110 to a fixing wire 51*ac* when the first supporting member 110 is folded to the basket 51.

The first supporting member 110 may include a rotation restricting portion 111*b* that is supported by a rotation restricting wire 51*ad* of the basket 51 when the first supporting member 110 is unfolded from the basket 51. The rotation restricting portion 111*b* may be positioned on one surface of the first frame 111. A rotation range of the first supporting member 110 with respect to the basket 51 may be restricted by the rotation restricting portion 111*b*. More specifically, referring to FIG. 6, the first supporting member 110 may be unfolded to a first angle a with respect to the basket 51. The first angle a may be set to about 85°.

Referring to FIGS. 3 and 7, the first supporting member 110 may include a first holding portion 115 for fixing and supporting a stem portion of a wine glass 01 when the first supporting member 110 supports the wine glass 01. At least one portion of the first holding portion 115 may include a flexible material. The first holding portion 115 may include a fixing groove 115*c* formed at a portion of an edge of the first frame 111, a supporting protrusion 115*a* protruding toward inside of the fixing groove 115*c*, and a deformable portion 115*b* positioned at an opening of the fixing groove 115*c*. The stem portion of the wine glass 01 may be inserted into the inside of the fixing groove 115*c* and firmly supported and fixed by the supporting protrusion 115*a* and the deformable portion 115*b*.

When the stem portion of the wine glass 01 is inserted into the fixing groove 115*c*, the deformable portion 115*b* may be deformed. That is, the deformable portion 115*b* may have an opening that is smaller than a diameter of the stem portion of the wine glass 01, and, after the stem portion of the wine glass 01 is inserted into the fixing groove 115*c*, the deformable portion 115*b* may support the stem portion of the wine glass 01 to prevent the stem portion of the wine glass 01 from escaping from the inside of the fixing groove 115*c*.

Referring to FIG. 5, the first supporting member 110 may include a first connecting member coupling portion 117 to which the connecting member 130 is rotatably connected. When one end of the connecting member 130 is rotatably coupled to the first connecting member coupling portion 117, the first supporting member 110 may be rotatable with respect to the connecting member 130.

The first supporting member 110 may include an accommodating groove 118 in which the connecting member 130 is accommodated when the first frame 111 is folded to the basket 51. The accommodating groove 118 may have a shape and size corresponding to the connecting member 130.

The second supporting member 120 may be positioned below the first supporting member 110, and rotatably coupled to the second support wire 51*ab* of the basket 51. The second supporting member 120 may interwork with the first supporting member 110 by the connecting member 130. The second supporting member 120 may include a second frame 121 for supporting dishes. The second supporting member 120 may be rotatable between a third position of being folded to the basket 51 and a fourth position of being unfolded from the basket 51.

The second frame 121 may be in the shape of a substantially quadrangular plate, and include a first through hole 121*a* through which water passes when the dish washer 1 washes dishes.

The second supporting member 120 may include a second wire coupling portion 122 extending from the second frame 121 and coupled to the second supporting wire 51*ab*. The second wire coupling portion 122 may be in the shape of a hook, and rotatably coupled to the second supporting wire 51*ab*.

When the second supporting member 120 is unfolded from the basket 51, a rotation of the first supporting member 110 may be restricted so that a radius of rotation of the second supporting member 120 is also restricted. That is, because the second supporting member 120 interworks with the first supporting member 110 by the connecting member 130, a rotation of the second supporting member 120 may be restricted when a rotation of the first supporting member 110 is restricted. More specifically, referring to FIG. 6, the second supporting member 120 may be unfolded to a second angle b with respect to the basket 51. The second angle b may be set to about 100°.

Because the first supporting member 110 and the second supporting member 120 support different portions of the wine glass 01, the first supporting member 110 and the second supporting member 120 may be unfolded to different angles with respect to the basket 51.

The second frame 121 may include a second holding portion 125 for supporting an end of the wine glass 01 when the second supporting member 120 is unfolded with respect to the basket 51.

More specifically, referring to FIGS. 3 and 7, at least one portion of the second holding portion 125 may include a flexible material. More specifically, the second holding portion 125 may include a center portion 125*a* including a relatively hard material and an edge portion 125*b* including a relatively flexible or soft material. A size of a cross section of the center portion 125*a* may be about a half of a size of the entire cross section of the second holding portion 125. According to the configuration of the second holding portion 125, the second holding portion 125 may stably and softly support a lip portion of the wine glass 01 while maintaining its rigidity.

The second holding portion 125 may be manufactured by double injection molding or by welding the edge portion 125*b* to the center portion 125*a*. The edge portion 125*b* may include a material that may endure heat of about 80° C. to 90° C. More specifically, the edge portion 125*b* may include thermoplasticity poly urethane (TPU).

The second holding portion 125 may be in the shape of a hook bent to a predetermined angle C. Referring to FIG. 6, the second holding portion 125 may be designed to be bent to the angle C at which the second holding portion 125 may support wine glasses of various sizes.

The second supporting member 120 may include a second connecting member coupling portion 127 to which the connecting member 120 is rotatably connected. When one end of the connecting member 130 is rotatably coupled to the second connecting member coupling portion 127, the second supporting member 120 may be rotatable with respect to the connecting member 130.

One end of the connecting member 130 may be rotatably connected to the first supporting member 110, and the other end of the connecting member 130 may be rotatably connected to the second supporting member 120. The connecting member 130 may enable the first supporting member 110 to interwork with the second supporting member 120. A plurality of connecting members 130 may be provided. More specifically, referring to FIG. 4, the connecting member 130 may include a connecting body 131, a first connecting portion 133 positioned at one end of the connecting body 131, and a second connecting portion 134 positioned at the other end of the connecting body 131 that is opposite to the one end of the connecting body 131.

The connecting body 131 may extend to a predetermined length. The connecting body 131 may extend from the first supporting member 110 to the second supporting member 120. The first connecting portion 133 may be rotatably coupled to the first connecting member coupling portion 117 of the first supporting member 110. The second connecting portion 134 may be rotatably coupled to the second connecting member coupling portion 127 of the second supporting member 120.

Hereinafter, an operation of the supporting device 100 according to an embodiment of the disclosure will be described.

Referring to FIGS. 3 and 7, the first supporting member 110 may be located at the second position of being unfolded from the basket 51, and the second supporting member 120 may be located at the fourth position of being unfolded from the basket 51 so that the supporting device 100 supports dishes. As such, a state in which the first supporting member 110 and the second supporting member 120 are unfolded from the basket 51 is referred to as a first mode of the supporting device 100. When the supporting device 100 is in the first mode, the lip portion being an end of the wine glass 01 may be supported by the second holding portion 125 of the second supporting member 120, and the stem portion of the wine glass 01 may be supported by the first holding portion 115 of the first supporting member 110.

Meanwhile, referring to FIG. 5, when the supporting device 100 does not need to support the wine glass 01, the first supporting member 110 may be located at the first position of being folded to the basket 51 and the second supporting member 120 may be located at the third position of being folded to the basket 51 to secure a space of the basket 51. As such, a state in which the first supporting member 110 and the second supporting member 120 are folded to the basket 51 is referred to as a second mode of the supporting device 100. When the supporting device 100 is in the second mode, space utilization of the basket 51 may increase because dishes may be held in a space of the basket 51 previously occupied by the supporting device 100.

The first supporting member 110 may be rotatable between the first position and the second position, and the second supporting member 120 may be rotatable between the third position and the fourth position. The second supporting member 120 may interwork with the first supporting member 110 by the connecting member 130. The dish washer 1 according to an embodiment of the disclosure may firmly support and fix the wine glass 01 as necessary by the supporting device 100 provided in the basket 51, and fold the supporting member 100 to one side of the basket 51 as unnecessarily to additionally hold dishes in the space of the basket 51 previously occupied by the supporting device 100.

Figure 8:
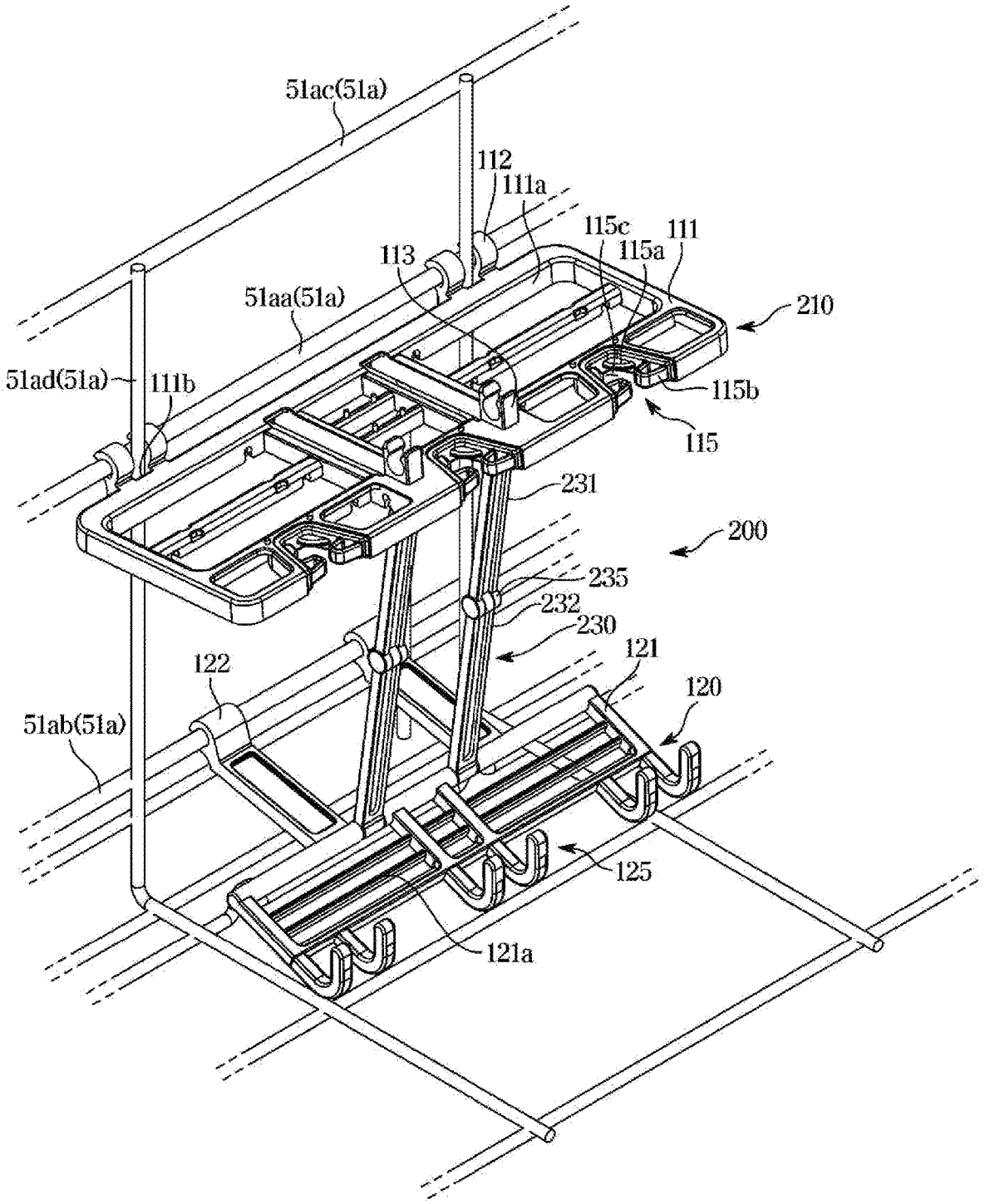
FIG. 8 shows a supporting device according to another embodiment of the disclosure.
Figure 9:
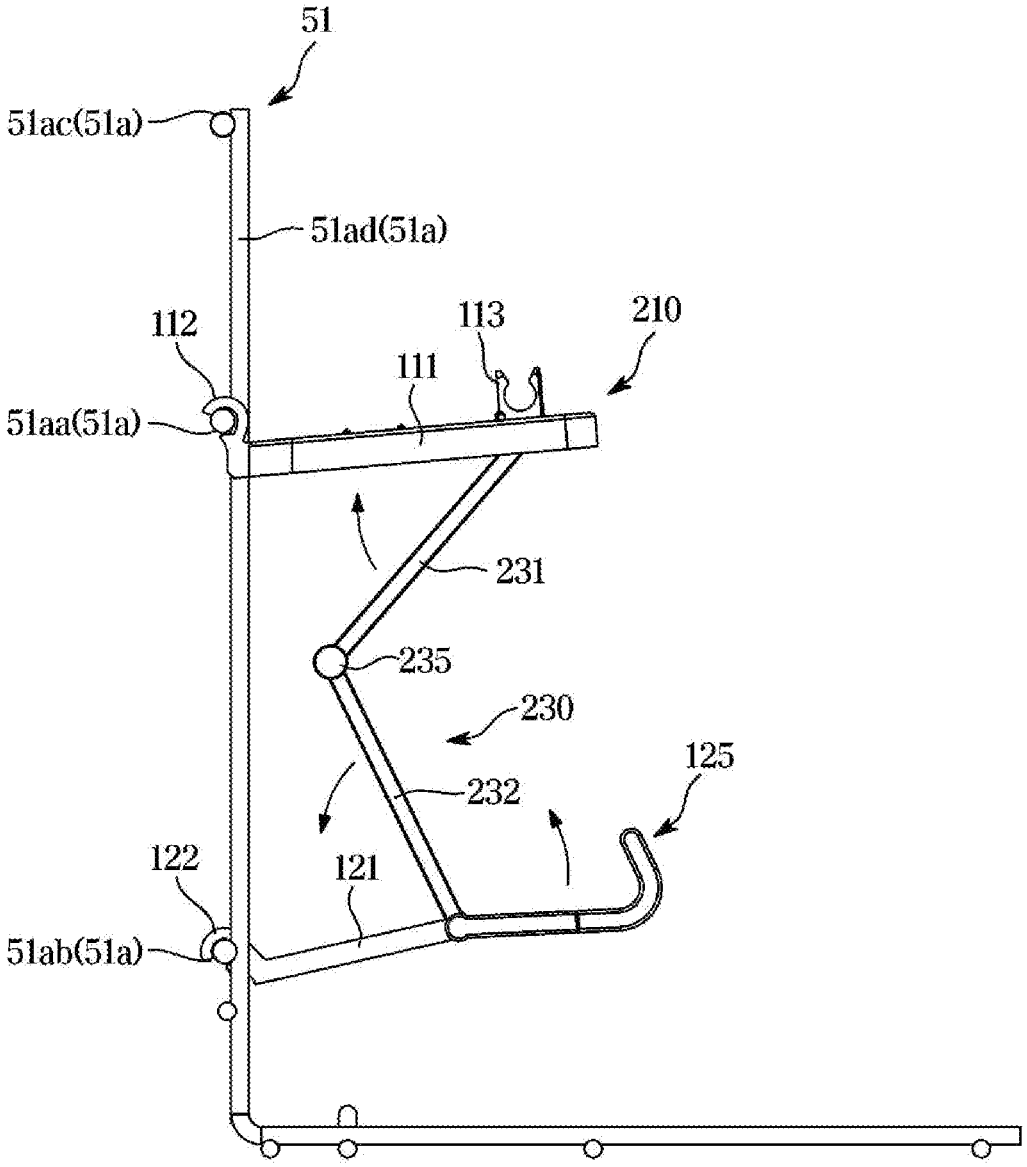
FIG. 9 shows an operation for setting the supporting device shown in FIG. 8 to a third mode.
Figure 10:
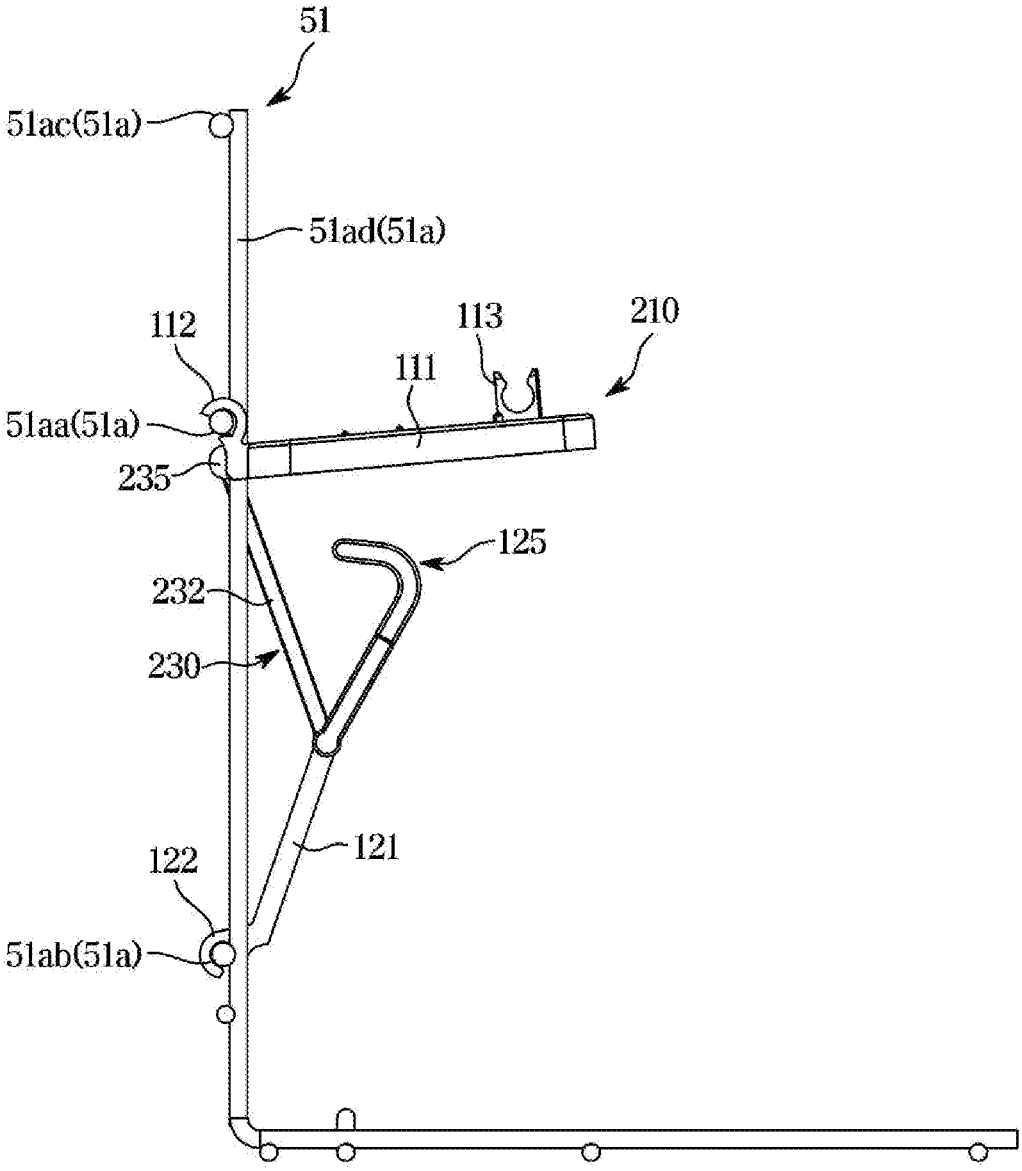
FIG. 10 shows a state in which the supporting device shown in FIG. 8 is set to the third mode.
Figure 11:
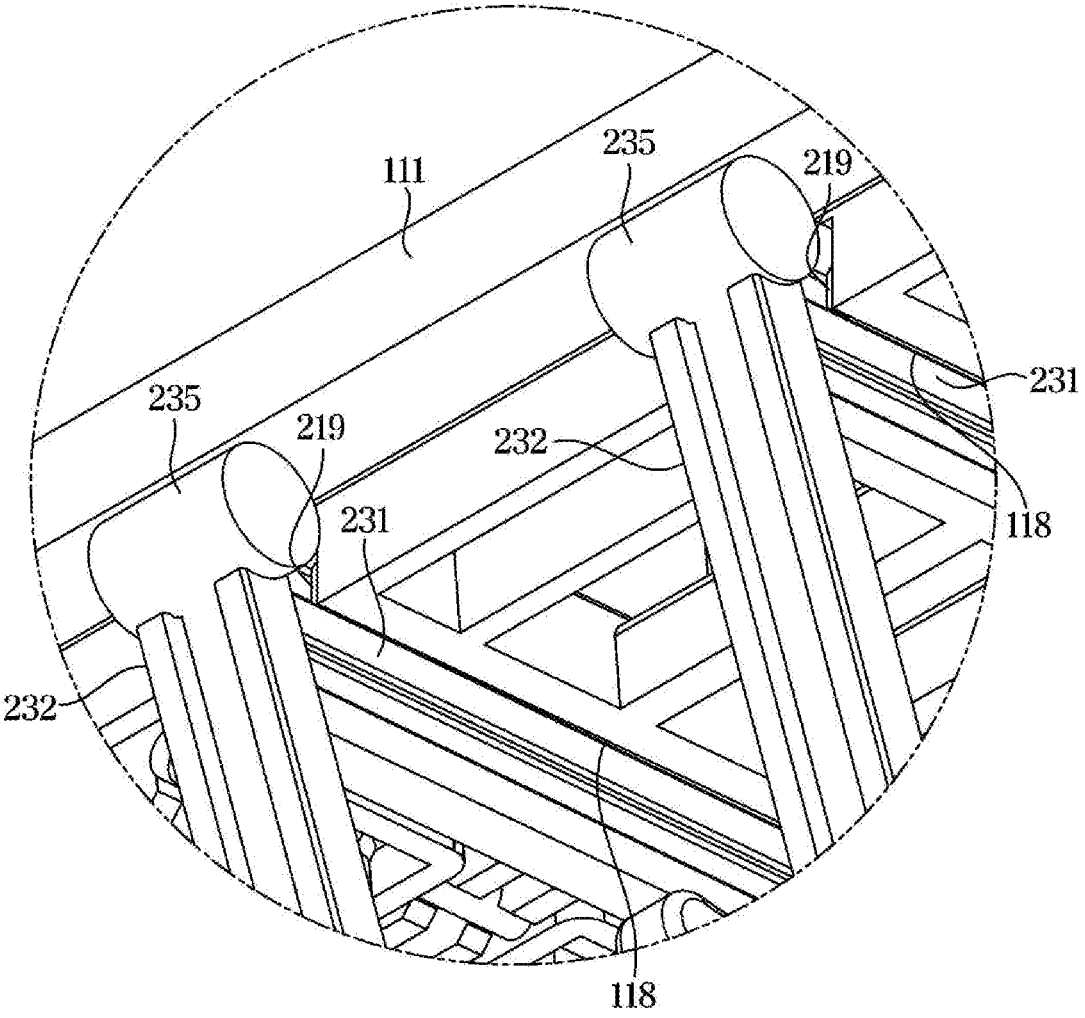
FIG. 11 shows a portion of a first supporting member to which a connecting member is fixed when the supporting device shown in FIG. 8 is set to the third mode.
Figure 12:
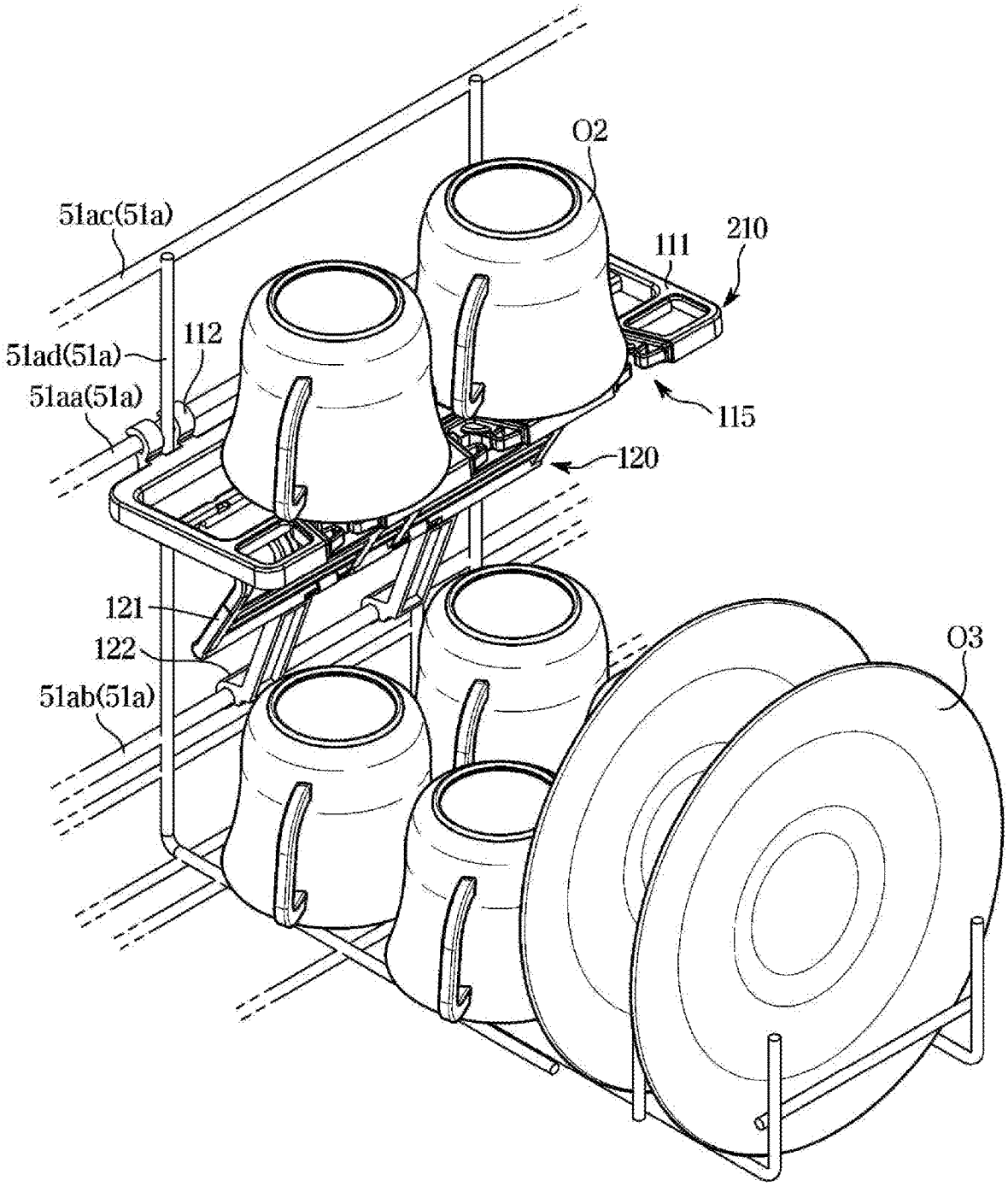
FIG. 12 shows a state in which dishes are held on the supporting device shown in FIG. 10.

FIG. 8 shows a supporting device according to another embodiment of the disclosure. FIG. 9 shows an operation for setting the supporting device shown in FIG. 8 to a third mode. FIG. 10 shows a state in which the supporting device shown in FIG. 8 is set to the third mode. FIG. 11 shows a portion of a first supporting member to which a connecting member is fixed when the supporting device shown in FIG. 8 is set to the third mode. FIG. 12 shows a state in which dishes are held in the supporting device shown in FIG. 10.

In the embodiment shown in FIGS. 8 to 12, the same components as those in the embodiment shown in FIGS. 1 to 7 will be assigned the same reference numerals as those assigned in the embodiment shown in FIGS. 1 to 7, and detailed description thereof will be omitted.

Referring to FIG. 8, a supporting device 200 according to another embodiment of the disclosure may include a connecting member 230 including a first arm 231, a second arm 232, and a joint 235, unlike the supporting device 100 shown in FIGS. 1 to 7.

More specifically, unlike the connecting member 130 constructed as one body (that is, the connecting body 131) as shown in FIGS. 1 to 7, the connecting member 230 shown in FIG. 8 may include the first arm 231 rotatably connected to a first supporting member 210, the second arm 232 rotatably connected to the second supporting member 120, and the joint 235 rotatably connecting the second arm 232 to the first arm 231.

Referring to FIGS. 9 and 10, an operation of the supporting device 200 according to another embodiment of the disclosure will be described. The supporting device 200 according to another embodiment of the disclosure may be set to a first mode as shown in FIG. 8 or to the second mode of the above-described embodiment as shown in FIG. 5.

Referring to FIGS. 9 and 10, the supporting device 200 may fold the second supporting member 120 to the basket 51, and unfold the first supporting member 210 from the basket 51. A state in which the first supporting member 210 is unfolded from the basket 51 and the second supporting member 120 is folded to the basket 51 is referred to as a third mode of the supporting device 200.

More specifically, referring to FIG. 9, in the state in which the first supporting member 210 is unfolded with respect to the basket 51, the first arm 231 may rotate in a clockwise direction with respect to the first supporting member 210 so that the joint 235 may rise, and the second arm 232 may rotate in a counterclockwise direction so that the second supporting member 120 may rotate in the counterclockwise direction.

Referring to FIGS. 10 and 11, the first arm 231 may rotate to be inserted into the accommodating groove 118 of the first supporting member 210, and accordingly, the joint 135 may rise to be adjacent to the first supporting member 210. The second arm 232 may rotate the second supporting member 120 to be folded to the basket 51. The first supporting member 210 may include a fixing member 219 for fixing the first arm 231 of the connecting member 230 when the supporting device 200 is in the third mode. The fixing member 219 may be positioned at one end of the accommodating groove 118 and protrude toward inside of the accommodating groove 118. The fixing member 219 may be pressed and deformed when the first arm 231 is inserted into the accommodating groove 118, and, when the first arm 231 is completely inserted into the accommodating groove 118, the fixing member 219 may be restored to its original shape to prevent the first arm 231 from escaping from the accommodating groove 118.

Referring to FIG. 12, the supporting device 200 according to another embodiment of the disclosure may be in the third mode in which the first supporting member 210 is unfolded from the basket 51 and the second supporting member 120 is folded to the basket 51. In this case, an object such as a teacup 02 having a low height may be held on the first supporting member 210, and also, below the first supporting member 210, that is, in a space previously occupied by the second supporting member 120, an object such as the teacup 02 having a relatively low height may be held. The dish washer 1 having the supporting device 200 according to another embodiment of the disclosure may increase space utilization. Also, an object such as a plate 03 may be held in the basket 51.

Figure 13:
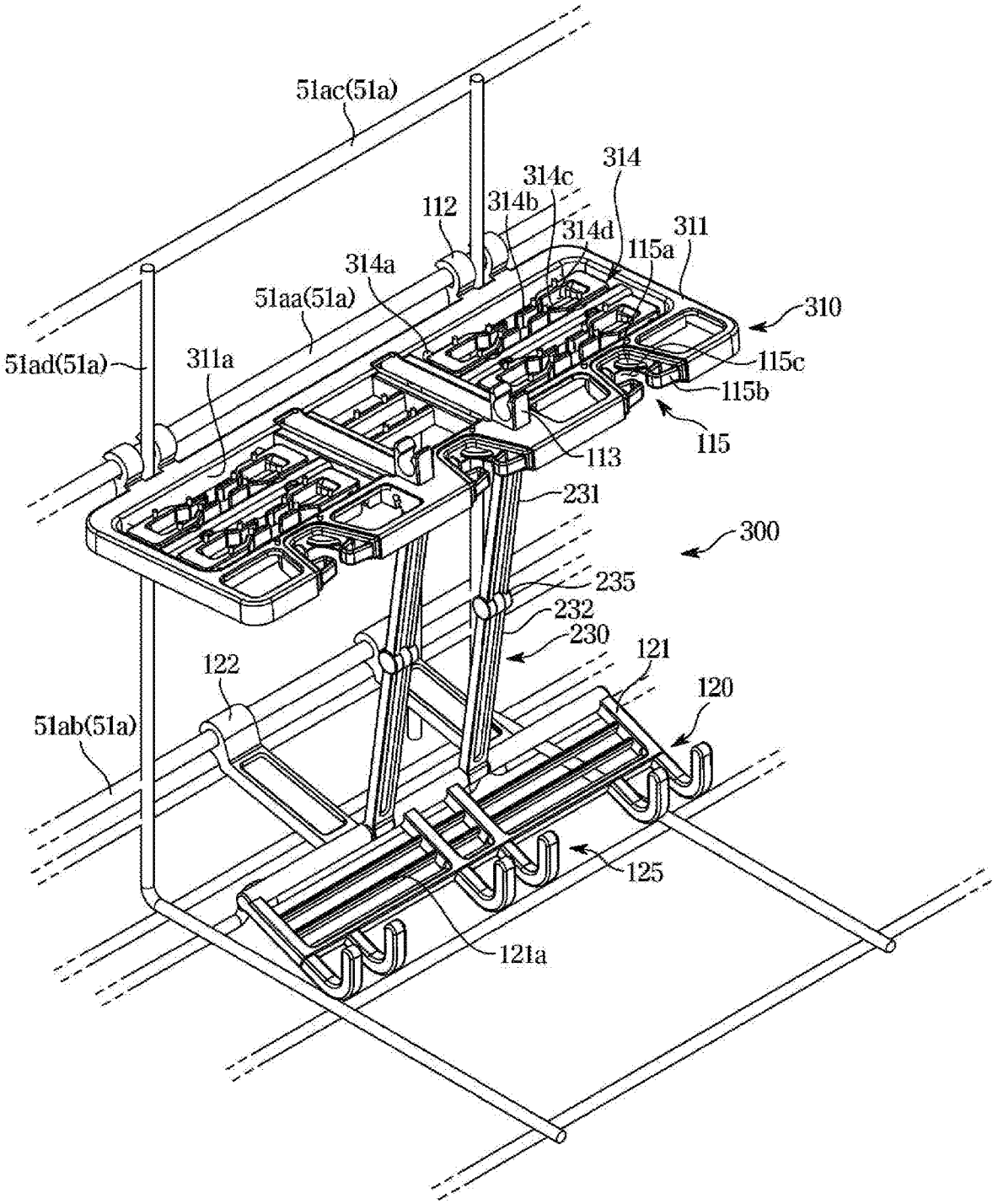
FIG. 13 shows a supporting device according to another embodiment of the disclosure.
Figure 14:
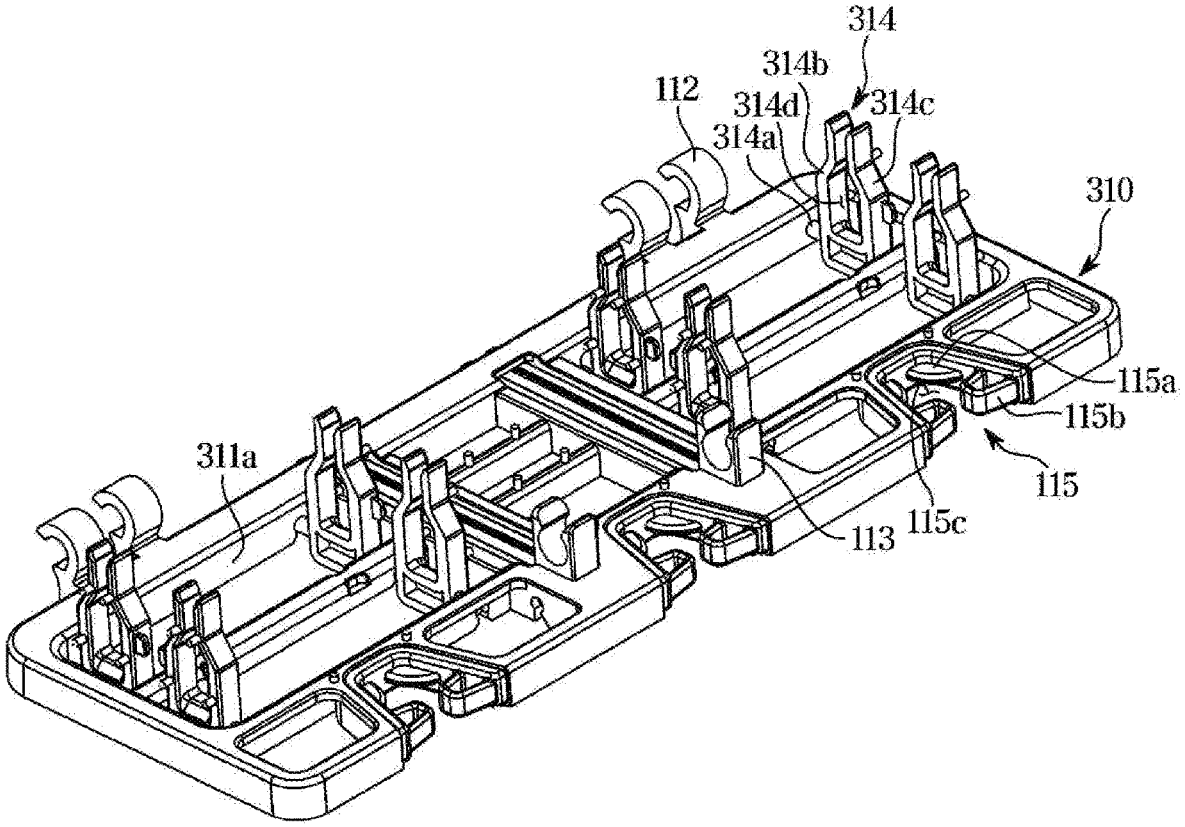
FIG. 14 shows a state in which a supporting unit of the supporting device shown in FIG. 13 is unfolded.
Figure 15:
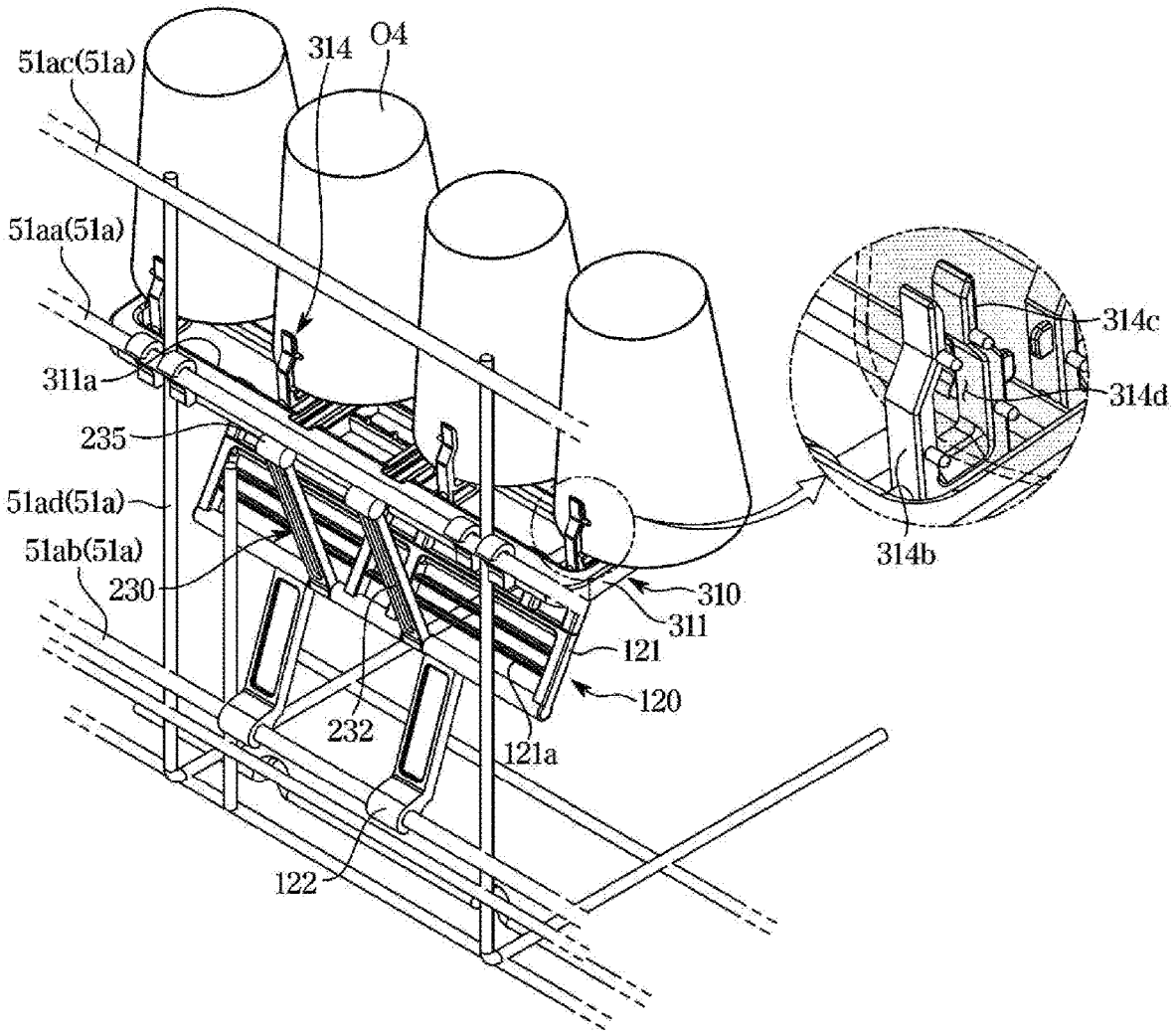
FIG. 15 shows a state in which dishes are held on a first supporting member of the supporting device shown in FIG. 14.
Figure 16:
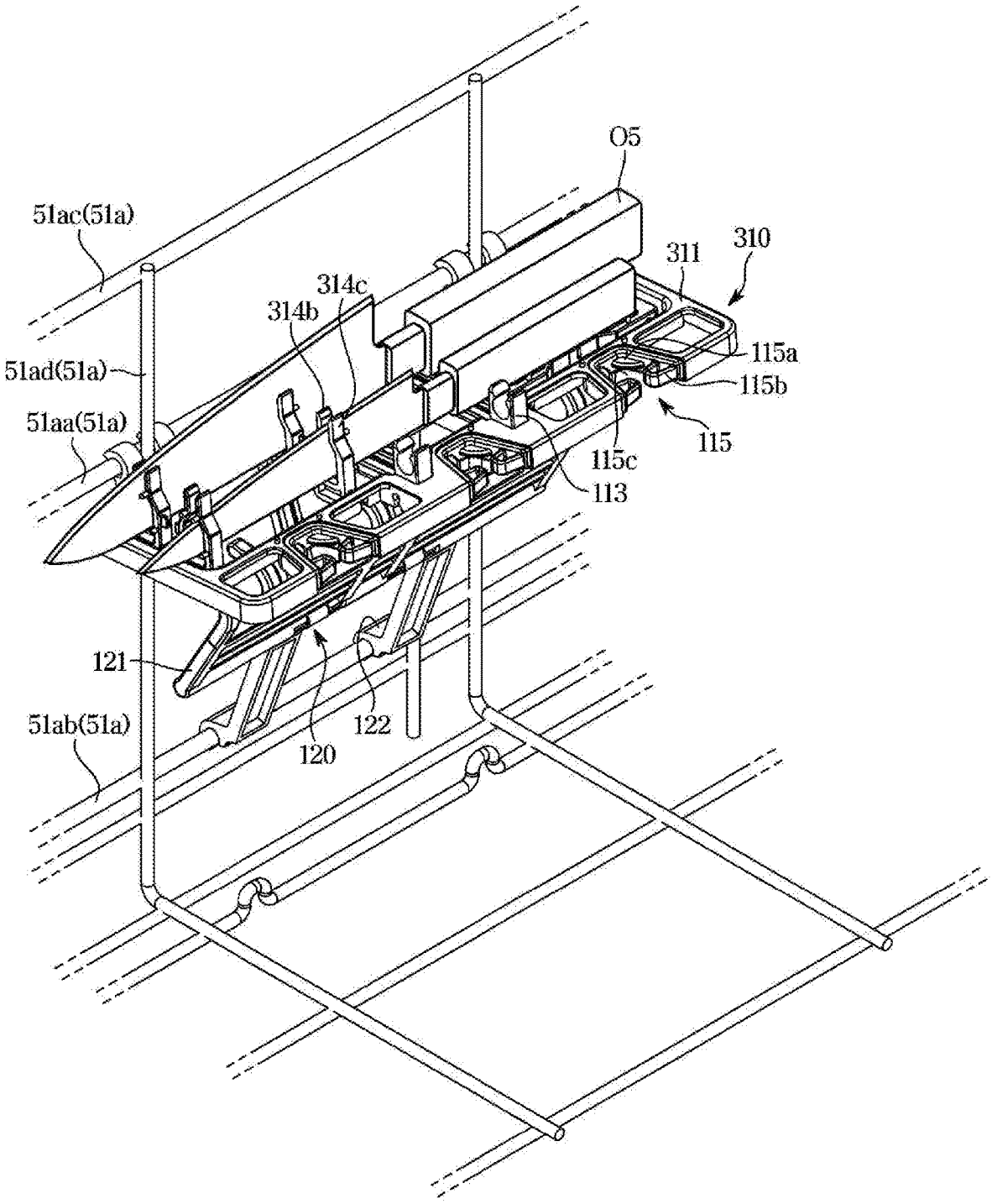
FIG. 16 shows a state in which different kinds of dishes from the dishes shown in FIG. 15 are held on the first supporting member of the supporting device shown in FIG. 14.

FIG. 13 shows a supporting device according to another embodiment of the disclosure. FIG. 14 shows a state in which a supporting unit of the supporting device shown in FIG. 13 is unfolded. FIG. 15 shows a state in which dishes are held on a first supporting member of the supporting device shown in FIG. 14. FIG. 16 shows a state in which different kinds of dishes from the dishes shown in FIG. 15 are held on the first supporting member of the supporting device shown in FIG. 14.

In the embodiment shown in FIGS. 13 to 16, the same components as those in the embodiment shown in FIGS. 1 to 12 will be assigned the same reference numerals as those assigned in the embodiment shown in FIGS. 1 to 12, and detailed descriptions thereof will be omitted.

Referring to FIGS. 13 and 14, a supporting device 300 according to another embodiment of the disclosure may include at least one supporting unit 314 in a first supporting member 310. However, the second supporting member 120 may have the same configuration as the second supporting member 120 shown in FIGS. 1 to 7, and the connecting member 230 may also have the same configuration as the connecting member 230 shown in FIGS. 8 to 12.

The supporting unit 314 may be rotatably coupled to a first frame 311. The supporting unit 314 may be positioned in a first through hole 311*a* of the first frame 311. When the first frame 311 is unfolded from the basket 51, the supporting unit 314 may rotate with respect to the first frame 311 in a direction of supporting dishes to be rested on the first frame 311. When the first frame 311 is unfolded from the basket 51, the supporting unit 314 may rotate to protrude from an upper surface of the first frame 311. The supporting unit 314 may rotate on a supporting unit rotating shaft 314*a*. A plurality of supporting units 314 may be provided, and the plurality of supporting units 314 may rotate independently.

The supporting unit 314 may include a first supporting portion 314*b* and a second supporting portion 314*c*. A supporting space for supporting dishes may be formed between the first supporting portion 314*b* and the second supporting portion 314*c*. The second supporting portion 314*c* may be spaced a predetermined distance from the first supporting portion 314*b*.

More specifically, referring to FIG. 15, when the supporting device 300 is in the third mode, an object such as a water glass 04 may be held on the first supporting portion 310, and a supporting unit 340 of the first supporting member 310 may hold the water glass 04. More specifically, a lip portion of the water glass 04 may be inserted into a supporting space 314*d* formed between the first supporting portion 314*b* and the second supporting portion 314*c*.

Referring to FIG. 16, on the first supporting member 310 of the supporting device 300, cutlery 05 such as a knife may be held. More specifically, the cutlery 05 may be inserted into the supporting space 314*d* formed between the first supporting portion 314*b* and the second supporting portion 314*c* of the supporting unit 314 and stably supported.

According to the above-described configuration, the dish washer 1 having the supporting device 300 according to another embodiment of the disclosure may more stably support and fix dishes held on the first supporting member 310.

According to a concept of the disclosure, because the supporting device installed in the basket is unfolded when being used and folded when being not used, the dish washer may improve space utilization of the basket.

According to another concept of the disclosure, because the first supporting member of the supporting device supports a stem portion of a wine glass and the second supporting member of the supporting device supports a lip portion of the wine glass, the dish washer may stably fix and support the wine glass.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A dish washer comprising:

a main body;

a basket provided inside the main body;

a first supporting member coupled to a first portion of the basket so as to be rotatable about a first axis between a first position of being folded to the basket and a second position of being unfolded from the basket;

a second supporting member positioned below the first supporting member and coupled to a second portion of the basket positioned below the first portion so as to be rotatable about a second axis positioned below the first axis between a third position of being folded to the basket and a fourth position of being unfolded from the basket; and a connecting member connected to the first supporting member and the second supporting member so as to rotate the second supporting member from the third position to the fourth position when the first supporting member rotates from the first position to the second position, wherein the connecting member is configured to be rotatable with respect to the first supporting member when the first supporting member is rotating between the first position and the second position, and rotatable with respect to the second supporting member when the second supporting member is rotating between the third position and the fourth position, and, when the first supporting member is in the second position and the second supporting member in the fourth position so that both the first supporting member and the second supporting member are unfolded from the basket, the first supporting member is configured to support a first part of an item to be washed in the dish washer and the second supporting member is configured to support, below the first part, a second part of the item to be washed in the dish washer.

2. The dish washer of claim 1, wherein, when the first supporting member rotates from the second position to the first position, the connecting member rotates the second supporting member from the fourth position to the third position.

3. The dish washer of claim 1, wherein, when the first supporting member is in the second position and the second supporting member is in the fourth position, an angle by which the first supporting member is unfolded is different from an angle by which the second supporting member is unfolded.

4. The dish washer of claim 1, wherein the first supporting member comprises a rotation restricting portion supported by the basket and restricting a rotation range of the first supporting member when the first supporting member is in the second position.

5. The dish washer of claim 1, wherein the first supporting member comprises a fixing portion that fixes to the basket when the first supporting member rotates to the first position.

6. The dish washer of claim 1, wherein the first supporting member comprises a first holding portion to hold, and thereby support, the first part of the item to be washed in the dish washer, the first holding portion comprising:

a fixing groove into which the first part of the item is insertable to be fixed in the fixing groove and thereby held by the first holding portion, and a deformable portion positioned in an opening of the fixing groove and which deforms when the first part of the item is inserted into the fixing groove.

7. The dish washer of claim 1, wherein the second supporting member comprises a holding portion in the shape of a hook bent by a predetermined angle to support the second part of the item to be washed in the dish washer.

8. The dish washer of claim 1, wherein, when the first supporting member is in the second position, the connecting member enables the second supporting member to rotate from the fourth position to the third position.

9. The dish washer of claim 8, wherein the connecting member comprises:

a first arm rotatably connected to the first supporting member, a second arm rotatably connected to the second supporting member, and a joint rotatably connecting the second arm to the first arm.

10. The dish washer of claim 9, wherein the first supporting member further comprises a fixing member that fixes the connecting member when the second supporting member rotates to the third position.

11. The dish washer of claim 1, wherein the connecting member supports the first supporting member and the second supporting member so that the first supporting member interworks with the second supporting member.

12. The dish washer of claim 1, wherein the first supporting member comprises:

a first frame rotatably coupled to the basket, and a supporting unit rotatably coupled to the first frame.

13. The dish washer of claim 12, wherein, when the first supporting member is in the second position, the supporting unit is rotatable to be in a position to support an additional item in a resting position on the first frame.

14. The dish washer of claim 12, wherein the supporting unit comprises a first supporting portion and a second supporting portion spaced from the first supporting portion to form a supporting space between the first supporting portion and the second supporting portion and in which the additional item is positionable in the resting position on the first frame.

15. The dish washer of claim 1, wherein the first supporting member comprises:

a first frame rotatably coupled to the basket, and a plurality of supporting units rotatably coupled to the first frame and which are rotatable independently to support a plurality of additional items to be washed in the dish washer respectively.

16. The dish washer of claim 1, wherein the item to be washed in the dish washer is a glass having a stem and a cup, the first part is the stem of the glass, and the second part is a lip of the cup of the glass.

17. A supporting device comprising:

a first supporting member coupleable to a first wire of a basket of a dish washer so as to be rotatable about a first axis;

a second supporting member coupleable to a second wire positioned below the first wire of the basket so as to be rotatable about a second axis positioned below the first axis; and a connecting member connected to the first supporting member and the second supporting member so that, when the first supporting member is coupled to the first wire and the second supporting member is coupled to the second wire, the first supporting member and the second supporting member are rotatable together, and, when the first supporting member is not rotating, the second supporting member is rotatable, wherein the first supporting member and the second supporting member are thereby rotatable to be in a first mode in which the first supporting member and the second supporting member are unfolded from the basket, with the first supporting member being configured to support a first part of an item to be washed in the dish washer and the second supporting member being configured to support, below the first part, a second part of the item to be washed in the dish washer, and a second mode in which the first supporting member and the second supporting member are folded to the basket, and the connecting member is configured to be rotatable with respect to each of the first supporting member and the second supporting member when the first supporting member and the second supporting member are rotating between the first mode and the second mode.

18. The supporting device of claim 17, wherein, when the first supporting member is coupled to the first wire and the second supporting member is coupled to the second wire, the first supporting member and the second supporting member are rotatable to set a third mode in which the first supporting member is unfolded from the basket and the second supporting member folded to the basket.

19. A dish washer comprising:

a main body;

a basket provided inside the main body;

a first supporting member coupled to a first portion of the basket and configured to be rotatable about a first axis;

a second supporting member positioned below the first supporting member, and coupled to a second portion of the basket positioned below the first portion, and configured to be rotatable about a second axis positioned below the first axis; and a connecting member connected to the first supporting member and the second supporting member and configured so that the first supporting member and the second supporting member are rotatable to positions at which both the first supporting member and the second supporting member are folded to the basket, the first supporting member and the second supporting member are rotatable to positions at which both the first supporting member and the second supporting member are unfolded from the basket, with the first supporting member being configured to support a first part of an item to be washed in the dish washer and the second supporting member being configured to support, below the first part, a second part of the item to be washed in the dish washer, and the first supporting member and the second supporting member are rotatable to positions at which the second supporting member is folded to the basket while the first supporting member is unfolded from the basket, with the first supporting member configured to support, by itself, an item to be washed in the dish washer, wherein the connecting member is configured to be rotatable with respect to the first supporting member when the first supporting member is rotating, and rotatable with respect to the second supporting member when the second supporting member is rotating.

20. The dish washer of claim 19, wherein, when the first supporting member and the second supporting member are both unfolded from the basket, the first supporting member is configured to support, by itself, a first additional item to be washed in the dish washer, and the second supporting member is configured to support, by itself, a second additional item to be washed in the dish washer.

* * * * *